US006668914B2

(12) United States Patent
Längl

(10) Patent No.: US 6,668,914 B2
(45) Date of Patent: Dec. 30, 2003

(54) MULTIPLE TUBE BUNDLE HEAT EXCHANGER

(75) Inventor: Alfred Längl, Meitingen (DE)

(73) Assignee: SGL Acotec GmbH, Siershahn (DE)

( * ) Notice: Subject to any disclaimer, the term of this patent is extended or adjusted under 35 U.S.C. 154(b) by 0 days.

(21) Appl. No.: 10/252,450

(22) Filed: Sep. 23, 2002

(65) Prior Publication Data

US 2003/0075309 A1 Apr. 24, 2003

Related U.S. Application Data

(63) Continuation-in-part of application No. 09/822,032, filed on Mar. 29, 2001.

(30) Foreign Application Priority Data

Mar. 29, 2000 (DE) ..... 100 15 717
Apr. 13, 2000 (DE) ..... 100 18 392

(51) Int. Cl.[7] ..... F28F 9/22; F28F 9/02

(52) U.S. Cl. ..... 165/145; 165/160; 165/173; 165/159

(58) Field of Search ..... 165/145, 173, 165/160, 159, DIG. 413

(56) References Cited

U.S. PATENT DOCUMENTS 1,683,236 A * 9/1928 Braun ..... 165/160
1,816,850 A * 8/1931 Hurd ..... 165/160
1,841,528 A * 1/1932 Gebhardt ..... 165/96
1,979,975 A * 11/1934 Maniscalco ..... 165/160
1,989,340 A * 1/1935 Shepherd ..... 165/101
2,169,564 A 8/1939 Maher
2,310,234 A * 2/1943 Haug ..... 165/160
2,577,832 A * 12/1951 Weiks ..... 165/160
4,548,261 A * 10/1985 Case et al. ..... 165/82

* cited by examiner

*Primary Examiner*—Henry Bennett
*Assistant Examiner*—Tho V Duong
(74) *Attorney, Agent, or Firm*—Laurence A. Greenberg; Werner H. Stemer; Ralph E. Locher

(57) ABSTRACT

A multiple tube bundle heat exchanger includes axially opposite tube plates, a housing, and a plurality of tube bundles disposed between the tube plates. Each of the tube bundles is an independent tube bundle subassembly forming an integral unit having at least one heat exchanger tube with two axial tube ends. The subassembly is made from the exchanger tube and respective tube plates fastened to the two axial tube ends. The housing has a casing part defining a interior and having two axial housing ends with flanges, removable head pieces respectively disposed at the two axial housing ends to be fastened to the flanges, and partitions subdividing the interior into chambers. The number of chambers corresponds to a number of tube bundles. Each of the chambers receives one of the tube bundles. The tube plates and head pieces respectively form seals, and the tube plates delimit distributor, collecting, and/or transfer chambers formed in the head pieces.

9 Claims, 4 Drawing Sheets

MULTIPLE TUBE BUNDLE HEAT EXCHANGER

CROSS-REFERENCE TO RELATED APPLICATION

This application is a continuation-in-part application of U.S. application Ser. No. 09/822,032, filed Mar. 29, 2001.

BACKGROUND OF THE INVENTION

Field of the Invention

The invention relates to a multiple tube bundle heat exchanger. In other words, the invention relates to a heat exchanger configuration that includes a plurality of flow-interconnected heat exchange tube bundles. The flow interconnection may relate either to the medium flowing through the tube bundles or to the medium flowing around the tube bundles, or to both.

Multiple tube bundle heat exchangers are already in the prior art. For example, Switzerland Patent No. CH 586 882 describes a counter-current tube bundle heat exchanger in the form of an in-series, tube bundle heat exchanger. In that heat exchanger, a common housing has disposed in it a plurality of tube bundles that are flow-connected in series and through which the primary medium flows in succession. All the tube bundles run between two tube sheets common to all the tube bundles, and the plenum chambers above each of the tube sheets are subdivided into partial chambers to form an inflow distributor chamber for the primary medium for distribution to the tubes of the first tube bundle, then a series of connecting chambers, disposed above the one tube sheet or the other, for connecting respectively the outlet ends of the tube bundle to the inlet ends of an adjacent tube bundle, and, finally, an outlet collecting chamber above the outlet ends of the last tube bundle in the flow series connection. Between the individual tube bundles are disposed, in the housing, partitions that respectively have fluid transfer orifices near one tube sheet or the other so that the secondary medium flows first into a first tube bundle chamber and then passes through the fluid transfer orifices from tube bundle chamber to tube bundle chamber and finally out of the last tube bundle chamber into an outlet.

SUMMARY OF THE INVENTION

It is accordingly an object of the invention to provide a multiple tube bundle heat exchanger that overcomes the hereinafore-mentioned disadvantages of the heretofore-known devices of this general type and that provides a configuration making it possible, on a modular basis, to construct economically the most diverse tube bundle heat exchanger configuration that is variable to the greatest possible extent both in terms of size and in terms of the flow configuration or of the routing of the primary medium and secondary medium.

With the foregoing and other objects in view, there is provided, in accordance with the invention, a multiple tube bundle heat exchanger, including a number of tube bundles, each of the tube bundles being formed as a self-contained integral unit having two axially spaced tube sheets and a plurality of heat exchanger tubes each with opposite axial ends, the two tube sheets mounted at the opposite axial ends of the heat exchanger tubes, a casing having a tubular portion substantially coextending with the tube bundles and having an interior subdivided by partitions into a plurality of axial chambers, a number of the axial chambers corresponding to the number of the tube bundles, each of the chambers receiving one of the tube bundles, two opposite axial ends, and flanges disposed at the two opposite axial ends, and head pieces removably mounted to the flanges, each of the head pieces having walls defining at least a first wall portion of a plenum chamber, and the two tube sheets of each of the tube bundles respectively sealing an adjacent one of the head pieces and forming at least a second wall portion of a respective plenum chamber of the adjacent one head piece.

In accordance with another feature of the invention, the partitions have at least one fluid transfer opening adjacent at least one of the two opposite axial ends of the tubular portion to allow fluid flowing through the interior of the tubular portion to pass between adjacent ones of the chambers.

In accordance with a further feature of the invention, the at least one fluid transfer opening is selectively obturated.

In accordance with an additional feature of the invention, the partitions have fluid transfer openings adjacent the two opposite axial ends of the tubular portion to allow fluid flowing through the interior of the tubular portion to pass between adjacent ones of the chambers.

In accordance with yet another feature of the invention, the fluid transfer openings are selectively obturated.

In accordance with yet a further feature of the invention, there is provided a separate intermediate piece disposed between at least one of the two opposite axial ends of the tubular portion and an adjacent one of the head pieces to form an axial extension of the tubular portion.

In accordance with yet an added feature of the invention, the intermediate piece has partitions forming axial extensions of the partitions of the tubular portion.

In accordance with yet an additional feature of the invention, the partitions of the intermediate piece have fluid transfer openings to allow fluid to pass between adjacent ones of the chambers in the tubular portion.

In accordance with a concomitant feature of the invention, there is provided a separate intermediate piece disposed between at least one of the two opposite axial ends of the tubular portion and an adjacent one of the head pieces to form an axial extension of the tubular portion, the intermediate piece having partitions forming axial extensions of the partitions of the tubular portion, and the partitions of the intermediate piece having fluid transfer openings to allow fluid to pass between adjacent ones of the chambers in the tubular portion.

The concept according to the invention provides for using standard heat exchanger tube bundles together with standard housing sub-assemblies that allow a multiplicity of combination possibilities and, of course, also heat exchanger configurations of different size.

Other features that are considered as characteristic for the invention are set forth in the appended claims.

Although the invention is illustrated and described herein as embodied in a multiple tube bundle heat exchanger, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
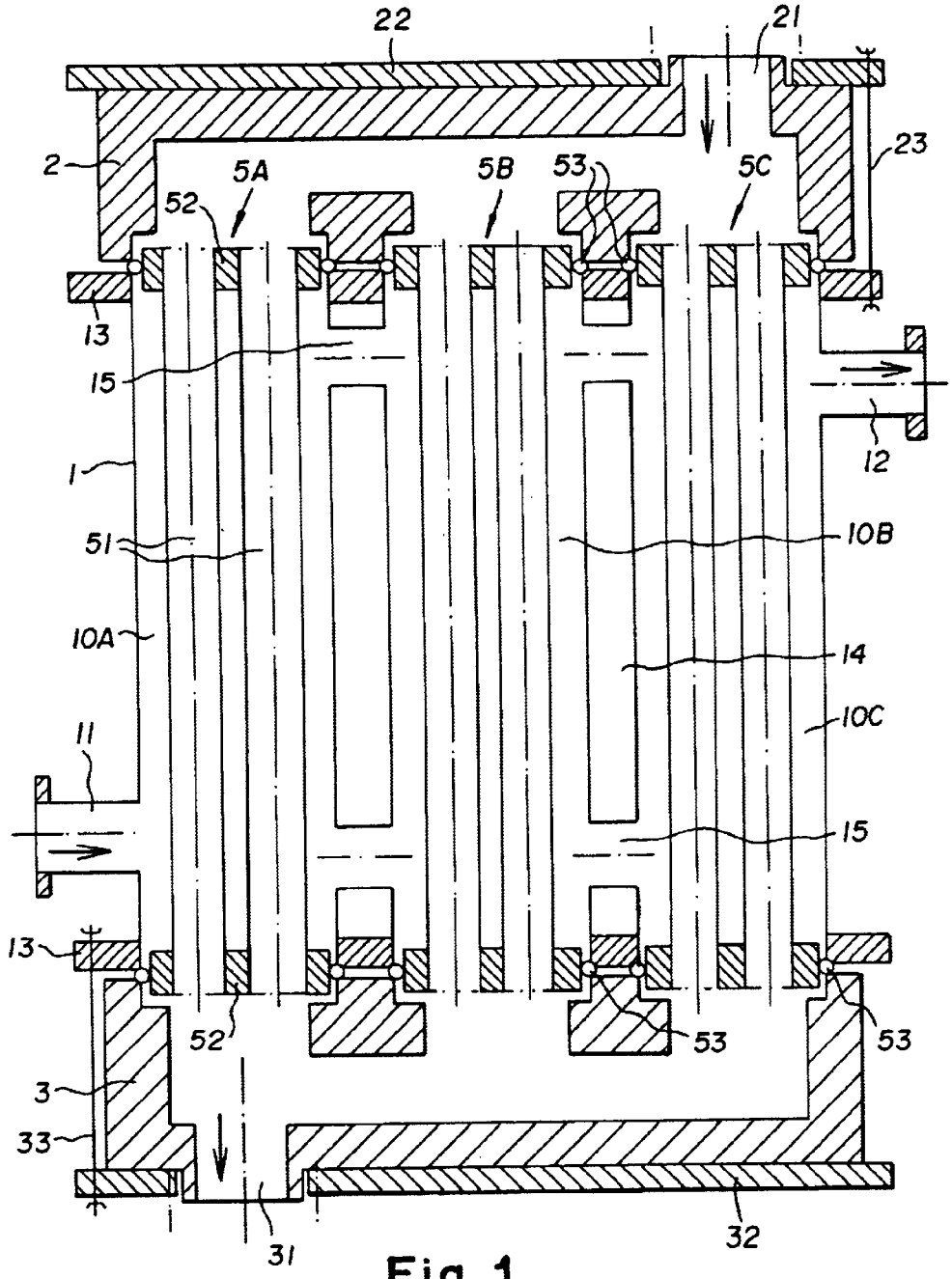
FIG. 1 is a cross-sectional view of a counter-current heat exchanger according to the invention constructed from a multiple configuration of tube bundles and having a parallel flow connection of the tube bundles.

In all the figures of the drawing, sub-features and integral parts that correspond to one another bear the same reference symbol in each case.

Referring now to the figures of the drawings in detail and first, particularly to FIG. 1 thereof, there is shown a heat exchanger having a casing and a plurality of tube bundles disposed therein.

The casing is made of a tubular casing portion 1, on which are disposed an inlet connection piece 11 and an outlet connection piece 12 respectively introducing and discharging a secondary medium into and out of the casing spaces. On both axial ends of the tubular casing portion 1 are flanges 13 and two head pieces 2, 3, which are disposed adjacent to the opposite axial ends of the tubular casing portion 1. The head pieces 2, 3 respectively have an inlet and an outlet connection piece 21, 31 for a primary medium to be conducted through the tube bundles. The head pieces 2, 3 each have an associated cover plate 22, 32 that can be clamped together with the flanges 13 of the casing 1 by screws or threaded rods 23, 33.

A plurality of tube bundles 5, specifically, in the exemplary embodiment illustrated, three tube bundles, which are designated 5A, 5B, and 5C, are installed in the casing. Each tube bundle includes a number of parallel heat exchanger tubes 51 disposed at distances from one another and two tube sheets 52 are respectively connected to these and located at the two opposite axial ends of the tube bundle.

Each tube bundle comprising a number of heat exchanger tubes 51 and the associated tube sheets 52 forms a separate module in the form of an integral unit and is installed as such in the casing. The seals 53 used for sealing off between the tubular casing portion 1, head pieces 2, 3, and the tube sheets 52 are illustrated only schematically in the drawings and can be implemented as O-ring seals or any other desired way, as required.

The interior of the tubular casing portion 1 is subdivided by partitions 14 into a number of chambers 10A, 10B, 10C corresponding to the number of tube bundles 5. The partitions 14 are provided at the top and bottom with passage orifices 15 through which the individual chambers 10A, 10B, 10C are connected to one another. The passage orifices can be selectively closed.

As can be seen, the plenum chambers, which are formed in the head pieces 2, 3, are not subdivided, but extend over all three tube bundles, so that a parallel flow through the three tube bundles 5A, 5B, 5C takes place. The three tube bundles 5A, 5B, 5C are, therefore, flow-connected in parallel.

Figure 2:
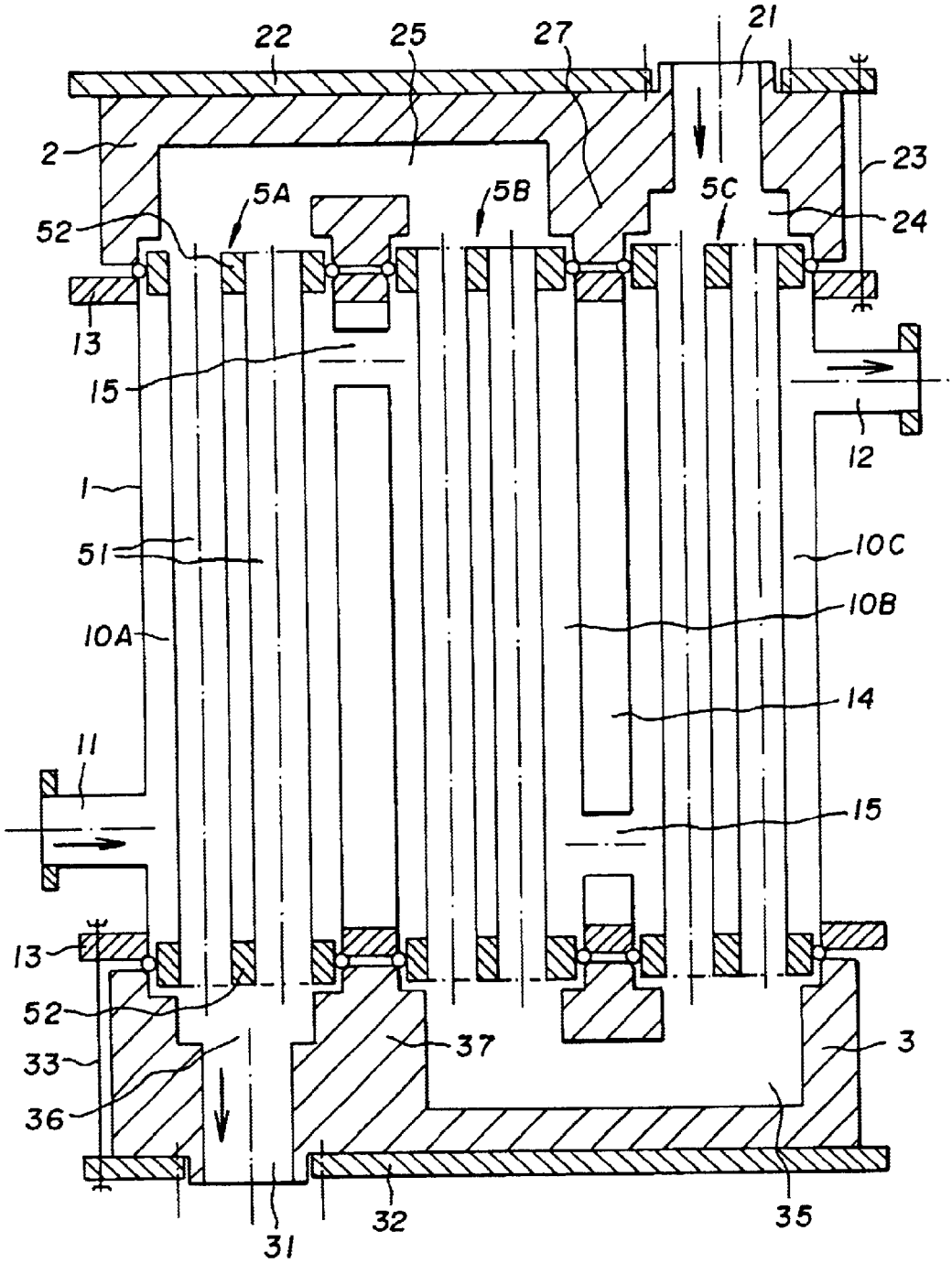
FIG. 2 is a cross-sectional view of an alternative embodiment of the counter-current heat exchanger of FIG. 1 with a plurality of tube bundles, flow-connected in series.

FIG. 2 shows a configuration that, again, includes a tubular casing portion 1 with three tube bundles 5A, 5B, 5C installed therein. The construction of the casing with a tubular casing portion 1, head pieces 2, 3, and connection pieces 11, 12, 21, 31 for the media involved in the heat exchange and the subdivision of the casing interior by partitions 14 into three chambers 10A, 10B, 10C correspond to the configuration according to FIG. 1.

The three tube bundles 5A, 5B, 5C in FIG. 2 are constructed in the same way as those in FIG. 1 and, again, respectively include heat exchanger tubes 51 and two tube sheets 52 at the two opposite axial ends of each tube bundle 5A, 5B, 5C, again, constituting an integral unit or separate module made up of these parts.

However, as compared with the configuration according to FIG. 1, in the configuration according to FIG. 2, the head pieces 2, 3 and the partitions 14 in the casing 1 are modified such that, in the configuration in FIG. 2, the three tube bundles are flow-connected in series. Also, the secondary medium flowing in through the connection piece 11 and flowing out through the connection piece 12 is routed, in all three tube bundles, in counter-current to the primary medium that flows in through the connection piece 21 and flows out through the connection piece 31 and that flows in succession through the heat exchanger tubes 51 of the three tube bundles. For that purpose, the head pieces 2 and 3 are modified such that an inlet plenum chamber 24 is formed above the inlet end of the first tube bundle 5C, as seen in the direction of flow of the primary medium. Also, a transfer chamber 35, 25 is formed respectively in the head pieces 3, 2 for transferring the primary medium between the adjacent ends of two fluidically successive tube bundles (from 5C to 5B through the transfer chamber 35 or from 5B to 5A through the transfer chamber 25), and an outflow plenum chamber 36 is formed above the outflow end of the last tube bundle, as seen in the direction of flow of the primary medium, that is to say 5A. Partitions 27, 37 for appropriately subdividing the head piece interior spaces into the corresponding chambers are, therefore, formed in the head pieces 2, 3.

Only one transfer orifice 15 is provided in each of the partitions 14 and is located near the respective tube plates so that a secondary medium must in each case flow, in counter-current to the medium flowing through the tube bundles, through essentially the entire axial length of the respective casing chamber until it pass through the respective transfer orifice 15 into the adjacent casing chamber.

For constructing configurations according to FIGS. 1 and 2, standard partitions 14 may be used, which, as illustrated in FIG. 1, may have, at both axial ends, transfer orifices, one of which is closed in each case to produce a configuration according to FIG. 2.

Different head pieces with or without partitions 27, 37 may also be kept ready, so that configurations according to FIGS. 1 and 2 can be produced, as required, from such elements in a modular manner.

Figure 3:
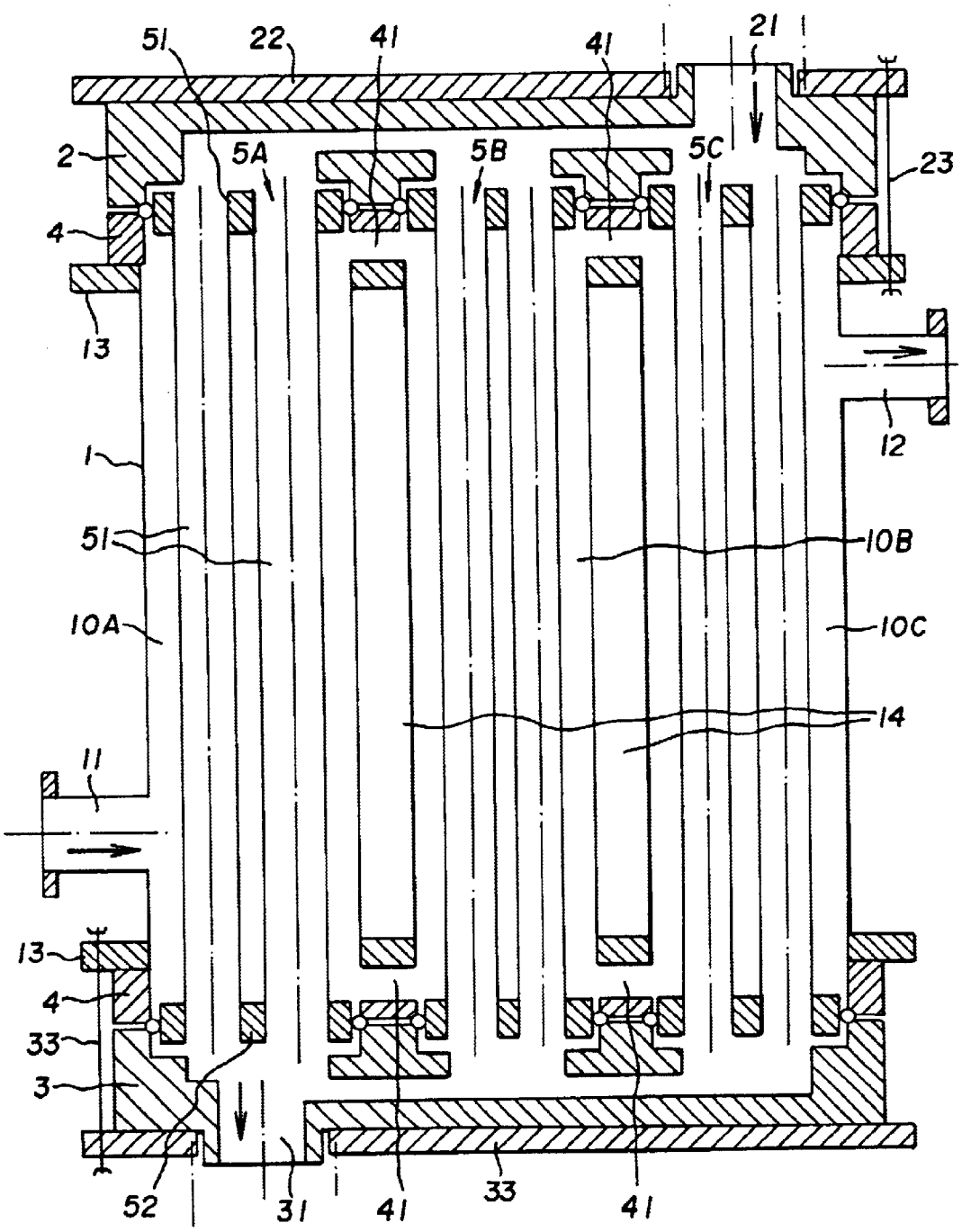
FIG. 3 is a cross-sectional view of an alternative embodiment of the counter-current heat exchanger of FIG. 1 with a plurality of tube bundles, flow-connected in parallel, and with an alternative housing configuration.
Figure 4:
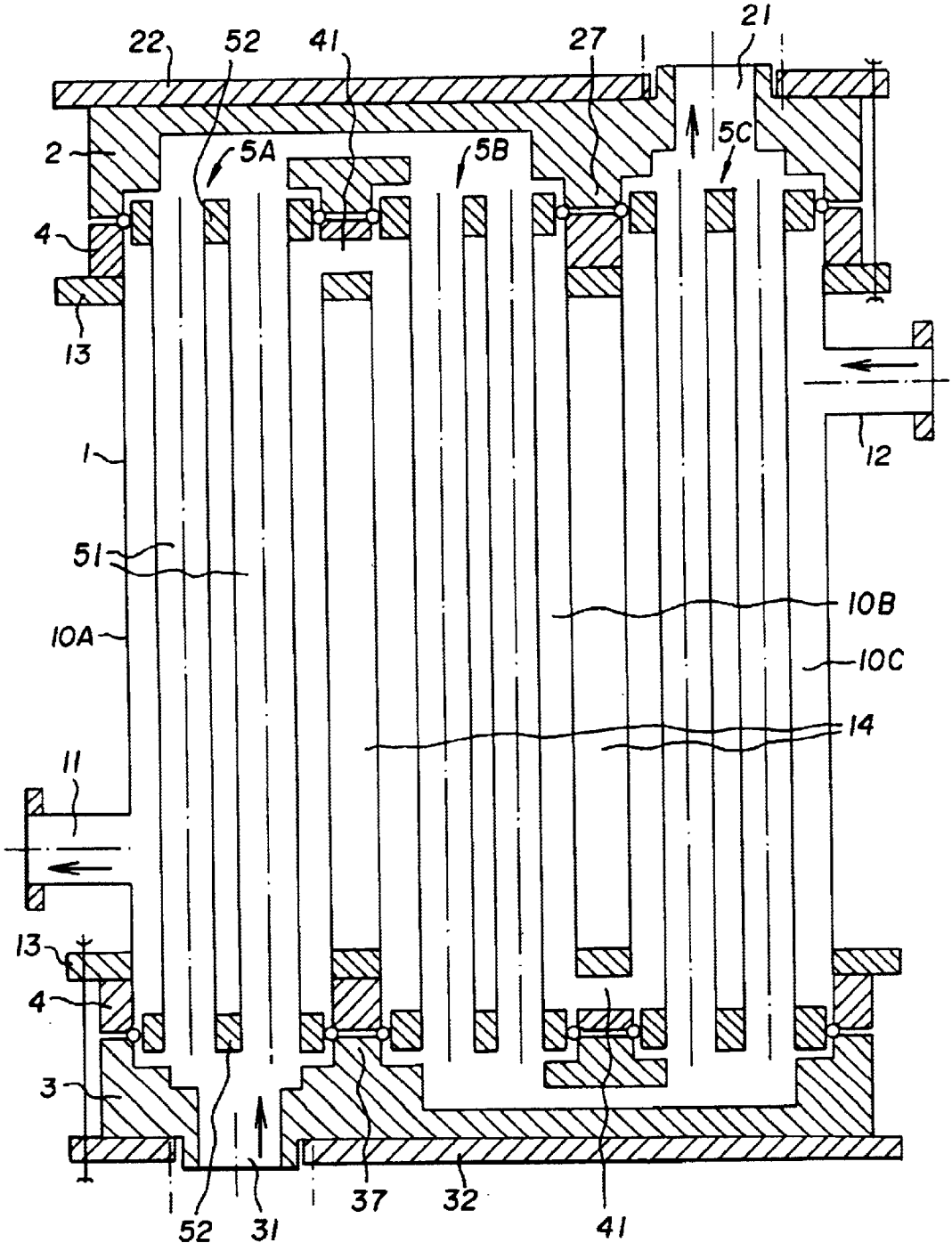
FIG. 4 is a cross-sectional view of an alternative embodiment of the counter-current heat exchanger of FIG. 3 with a plurality of tube bundles, flow-connected in series, and with a housing configuration developed in relation to the configuration according to FIG. 2.

FIGS. 3 and 4 show configurations similar to those according to FIGS. 1 and 2 of a multiple tube bundle heat exchanger with tube bundles flow-connected in parallel (FIG. 3) or with tube bundles flow-connected in series (FIG. 4). Identical or corresponding parts are, again, given the same reference symbols as in FIGS. 1 and 2.

The tube bundles 5A, 5B, 5C (of which there are, again, for example, three in each case) correspond to those according to FIGS. 1 and 2. The head pieces 2, 3 also correspond to those according to FIGS. 1 and 2. The same applies to the tubular casing portion 1 with the connection pieces 11, 12.

The configurations according to FIGS. 3 and 4, however, differ from the configurations according to FIGS. 1 and 2 in a modification or development of the casing structure. For, in the configurations according to FIGS. 3 and 4, the partitions 14 are configured without transfer orifices, that is to say, are completely closed. Instead, in the configurations according to FIGS. 3 and 4, the head pieces 2, 3 are each supplemented by an intermediate piece 4 that is disposed between the respective head piece and the flange 13 of the tubular casing portion 1 and that forms prolongations of the partitions 14, or, where fluid shall pass between adjacent casing chambers, have a transfer orifice 41.

As a result, the tubular casing portion 1 of the casing, together with the partitions 14, can be configured as a standard part, while different intermediate pieces 4 can be kept ready, as required, as parts to be used in a modular manner to produce transfer orifices between the casing chambers.

In configurations according to FIGS. 3 and 4, if the intermediate pieces 4 have sufficient axial length, the connection pieces for the tubular casing portion (in the embodiments illustrated, designated by 11 and 12 and disposed on the tubular casing portion 1) may also be disposed on the intermediate pieces 4. In such a case, it is possible not only to mount one or both connection pieces laterally on the respective intermediate piece 4, but also to configure it axially and lead it through the respective head piece 2, 3.

The above embodiments were described as counter-current heat exchangers by virtue of the arrows indicated in the drawings. It goes without saying that they may also be operated in the same way as co-current heat exchangers, for which purpose only the direction of flow of one of the two media needs to be reversed.

The concept according to the invention makes it possible to construct any desired heat exchangers using standard components. In particular, the tube bundles may be configured as standard components, from which any desired multiple tube bundle heat exchanger configurations of different size can be constructed, regardless of the intended operation as co-current or counter-current heat exchangers. For heat exchangers of different sizes, different housing structural parts, to be precise casings and head pieces, may be kept ready, these respectively being configured to receive a specific number of tube bundles, or variable block configurations of such casing structural parts may be provided. By using appropriate head pieces, to be precise, one for the tube bundles operating in parallel and one for the tube bundles connected in series, heat exchanger configurations can be constructed as required from relatively few basic components in a modular manner and, therefore, highly economically.

I claim:

1. A multiple tube bundle heat exchanger, comprising:

a number of tube bundles, each of said tube bundles being formed as a self-contained integral unit having:

two axially spaced tube sheets; and a plurality of heat exchanger tubes each with opposite axial ends, said two tube sheets mounted at said opposite axial ends of said heat exchanger tubes;

a casing having:

a tubular portion substantially coextending with said tube bundles and having:

an interior subdivided by partitions into a plurality of axial chambers, a number of said axial chambers corresponding to said number of said tube bundles, each of said chambers receiving one of said tube bundles;

two opposite axial ends; and flanges disposed at said two opposite axial ends; and head pieces removably mounted to said flanges, each of said head pieces having walls defining at least a first wall portion of a plenum chamber; and said two tube sheets of each of said tube bundles respectively sealing an adjacent one of said head pieces and forming at least a second wall portion of a respective plenum chamber of said adjacent one head piece.

2. The multiple tube bundle heat exchanger according to claim 1, wherein said partitions have at least one fluid transfer opening adjacent at least one of said two opposite axial ends of said tubular portion to allow fluid flowing through said interior of said tubular portion to pass between adjacent ones of said chambers.

3. The multiple tube bundle heat exchanger according to claim 2, wherein said at least one fluid transfer opening is selectively obturated.

4. The multiple tube bundle heat exchanger according to claim 1, wherein said partitions have fluid transfer openings adjacent said two opposite axial ends of said tubular portion to allow fluid flowing through said interior of said tubular portion to pass between adjacent ones of said chambers.

5. The multiple tube bundle heat exchanger according to claim 4, wherein said fluid transfer openings are selectively obturated.

6. The multiple tube bundle heat exchanger according to claim 1, including a separate intermediate piece disposed between:

at least one of said two opposite axial ends of said tubular portion; and an adjacent one of said head pieces to form an axial extension of said tubular portion.

7. The multiple tube bundle heat exchanger according to claim 6, wherein said intermediate piece has partitions forming axial extensions of said partitions of said tubular portion.

8. The multiple tube bundle heat exchanger according to claim 7, wherein said partitions of said intermediate piece have fluid transfer openings to allow fluid to pass between adjacent ones of said chambers in said tubular portion.

9. The multiple tube bundle heat exchanger according to claim 1, including a separate intermediate piece disposed between:

at least one of said two opposite axial ends of said tubular portion; and an adjacent one of said head pieces to form an axial extension of said tubular portion;

said intermediate piece having partitions forming axial extensions of said partitions of said tubular portion; and said partitions of said intermediate piece having fluid transfer openings to allow fluid to pass between adjacent ones of said chambers in said tubular portion.

* * * * *